US009339063B2

(12) United States Patent
Taylor

(10) Patent No.: US 9,339,063 B2
(45) Date of Patent: May 17, 2016

(54) ILLUMINATED NIPPLE COVER

(71) Applicant: Kelly Taylor, Key West, FL (US)

(72) Inventor: Kelly Taylor, Key West, FL (US)

( * ) Notice: Subject to any disclaimer, the term of this patent is extended or adjusted under 35 U.S.C. 154(b) by 0 days.

(21) Appl. No.: 14/535,774

(22) Filed: Nov. 7, 2014

(65) Prior Publication Data

US 2015/0150311 A1 Jun. 4, 2015

Related U.S. Application Data

(60) Provisional application No. 61/906,259, filed on Nov. 19, 2013.

(51) Int. Cl.
*A41C 3/06* (2006.01)
*A41C 3/00* (2006.01)

(52) U.S. Cl.
CPC ..... *A41C 3/065* (2013.01)

(58) Field of Classification Search
CPC ..... A41C 3/14; A41C 3/142; A41C 3/144; A21V 21/092; A21V 33/0004; A21V 33/0008; A21V 33/008
USPC ..... 450/81, 37, 54–57; 362/103, 104, 362/106–108, 800, 806; 623/7, 8
See application file for complete search history.

(56) References Cited

U.S. PATENT DOCUMENTS

| | | | | |
|---|---|---|---|---|
| 4,237,525 | A * | 12/1980 | Deter | 362/104 |
| 4,337,506 | A * | 6/1982 | Terada | 362/142 |
| 4,987,667 | A * | 1/1991 | Zwart | 63/12 |
| 5,125,244 | A * | 6/1992 | Zwart | 63/14.1 |
| 5,239,841 | A * | 8/1993 | Zwart | 63/12 |
| 6,200,195 | B1 * | 3/2001 | Furuno et al. | 450/81 |
| 2002/0117169 | A1 * | 8/2002 | Kurz et al. | 128/200.14 |
| 2003/0213045 | A1 * | 11/2003 | Fuentes | 2/69 |
| 2008/0009226 | A1 * | 1/2008 | Mouton | 450/57 |
| 2008/0071370 | A1 * | 3/2008 | Vinas | 623/7 |
| 2008/0198578 | A1 * | 8/2008 | Finn | 362/103 |
| 2012/0063123 | A1 * | 3/2012 | Redpath et al. | 362/103 |
| 2013/0271964 | A1 * | 10/2013 | Rife | 362/104 |

* cited by examiner

*Primary Examiner* — Gloria Hale
(74) *Attorney, Agent, or Firm* — Robert Sayfie

(57) ABSTRACT

An illuminated nipple cover that directs light to a skin contact member, which may be translucent or clear. The skin contact member is covered with an opaque cover so the skin contact member is illuminated, and the opaque cover blocks light from being seen from the skin contact member.

8 Claims, 4 Drawing Sheets

ILLUMINATED NIPPLE COVER

CROSS REFERENCE TO REALTED APPLICATIONS

This application claims priority from provisional patent application No. 61/906,259 filed on 19 Nov. 2013, titled Electronic Nipple Cover.

STATEMENT REGARDING FEDERALLY SPONSORED RESEARCH OR DEVELOPMENT

This invention is not federally sponsored.

BACKGROUND OF THE INVENTION

The present invention is in the technical field of lighting. More particularly, the present invention is in the technical field of body attachment. Women and men wear costumes for different events throughout the year. They wear nipple jewelry to decorate their bodies. They also wear body lights to decorate their bodies and to be seen at night. Nipple jewelry covers, also known as pasties, with adhesive backing do not include lights and body lights would have to be worn separately.

There exists a need for an illuminated device that is removably attached to a body.

There also exists the need to for a body attachment with a light for users to wear over nipples.

There also exists a need for an illuminated removable nipple cover to have a batter powered LED light that is attached in the center.

There also exists a need for a removable illuminated nipple cover having a dome shape design allows room for the light and provides a better fit over the breasts.

Multiple embodiments of the system are disclosed herein. It will be understood that other objects and purposes of the invention, and variations thereof, will be apparent upon reading the following specification and inspecting the accompanying drawings.

SUMMARY OF THE INVENTION

One aspect of the present invention is an illuminated nipple cover, comprising: a skin contact member 40 having an adhesive surface 140 on a concave side: a skin contact member light 60 positioned forwardly from said skin contact member 40, directing light rearwardly toward said skin contact member 40.

Another aspect of the present invention is an a skin contact member 40 having an adhesive surface 140 on a concave side: a skin contact member light 60 adjacent to said skin contact member 40; a color enhancement member 30 secured to a front side of said skin contact member 40; said color enhanced member 30 having a color enhancement member light aperture 80; an opaque cover 20 secured to the front side of said color enhanced member 30; said opaque cover 20 having an opaque cover light aperture 85; said skin contact member light 60 secured within said color enhancement member light aperture 80 and said skin contact member light 60 secured within said opaque cover light aperture 85.

These and other features, aspects and advantages of the present invention will become better understood with reference to the following drawings, description and claims.

DETAILED DESCRIPTION OF THE INVENTIONS

REFERENCE NUMERALS

Figure 1:
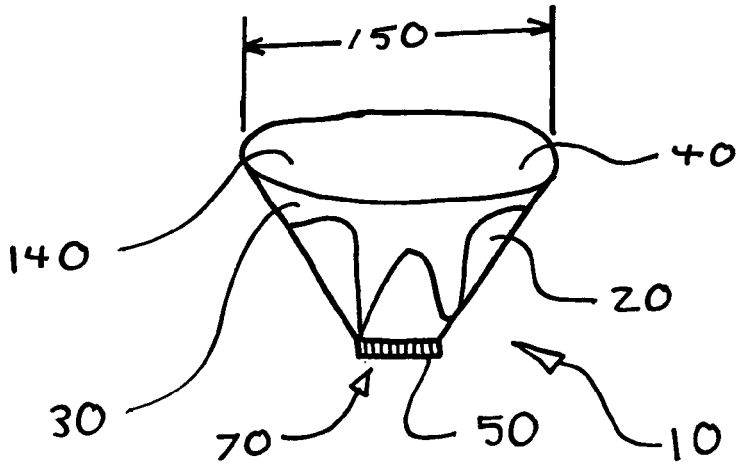
FIG. 1 is a perspective view of an illuminated nipple cover of the present invention.

10 Electronic Nipple Cover
20 Opaque Cover
30 Color Enhanced Member
40 Skin Contact Member
50 On-Off Switch
60 Skin Contact Member Light
70 Light with Switch
80 Color Enhancement Member Light Aperture
85 Opaque Cover Light Aperture
90 Opaque Cover Edges
100 Opaque Cover Cutout
110 Alternate Angled Surface members
120 Enhanced Color Member Cut Out
130 Enhanced Color Member Edges
140 Adhesive Surface
150 Base Diameter
160 Height The present invention 10 may be a body attachment with a skin contact member light 60 for users to wear, on their bodies, such as over nipples. The present invention 10 may combine nipple jewelry and nipple adhesive covers 49, also referred to as a skin contact member 40 with skin contact member lights 60 or skin contact member light 60 that directs light toward the skin contact member 40 body of the user. There may be a color enhanced member 40 secured between the skin contact member 40 and the opaque member 20. In one embodiment the color enhanced member 40 may be made from 20 gauge clear vinyl. Adhesive glue may be sprayed or applied on the vinyl. Colored cellophane may be attached to at least one side of the vinyl sheet, and work out any air bubbles. The vinyl sheets may also be painted with glitter paint, or any paint, and then sprayed with glitter. Or it may be left clear and used. Any transparent or translucent.

The opaque cover 20 may be made from resin rhinestone sheets with an adhesive back to apply to the vinyl, which is the color enhancement member 30.

Figure 2:
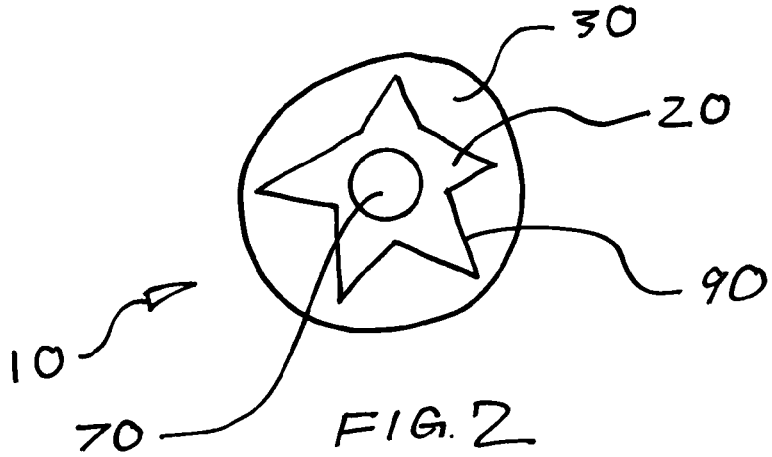
FIG. 2 is a top view of an illuminated nipple cover the present invention.

In one embodiment the illuminated nipple cover 10 may have a circular shape, as illustrated in FIG. 2. The skin contact member 40 may have a conical circular shape as illustrated in FIG. 1.

In one embodiment, the present invention 10 may have a skin contact member 40 that may be made of a double sided adhesive material, such as silicon. The skin contact member light 60 may have a battery powered LED light bulb, or any light bulb or illumination means that may be disposed in the center, in both the color enhancement member light aperture 80, and the opaque cover light aperture 85. The skin contact member 40 may be dome or conical shaped, as seen in FIG. 1, and may have an adhesive on the concave side of the skin contact member 40. The concave side of the skin contact ember 40 may also be referred to as the rear side, which is opposed to the front side of the skin contact member 40. The front side may also be referred to as the convex side of the skin contact member.

The skin contact member light 60 is disposed in the color enhancement member light aperture 80 and the opaque cover light aperture 85. Glue may be applied in any space in either aperture to secure the skin contact member light 60 within both apertures.

The conical or dome shape design of all the components when assembled allow room for the skin contact member light 60 or light and switch 70 and provides a better fit over a breast.

Referring now to the invention in more detail, FIG. 1, the illuminated nipple cover has a skin contact member 40 that may have an adhesive surface 140 which allows the electronic nipple cover 10 to be removably attached to a body, particularly a breast of the user. In one embodiment, the skin contact member 40 may be made of 2.5" diameter reusable silicone breast pads, although any size can be used.

FIG. 1 also illustrates a color enhanced member 30 securely disposed between the skin contact member 40 and an opaque cover 20. The rear side of said color enhanced member 30 may attach to the front side of the skin contact member 40. The opaque cover 20 may attach to the front side of the color enhanced member 30, which may be convex in shape.

As also seen in FIG. 1, in once embodiment, the base of the skin contact member 40 may be about 1 to 4 inches in diameter and may have a slight dome shape to fit comfortably over the breast.

FIG. 2 illustrates an illuminated nipple cover 10 having a color enhanced member 30, an opaque cover 20 secured to the color enhanced member 30. A light switch 70 is disposed through the opaque cover light aperture 85. FIG. 2 illustrates a circular shaped illuminated nipple cover 10. However the illuminated nipple cover 10 may be of any shape, such as diamond, triangular, square, or any shape.

In FIG. 2, the opaque cover 20 is illustrated as star shaped. However the opaque cover 20 can be any shape or color. For example, it may be shaped like the breast cancer awareness ribbon, a leaf, a skull, or any shape.

Figure 3:
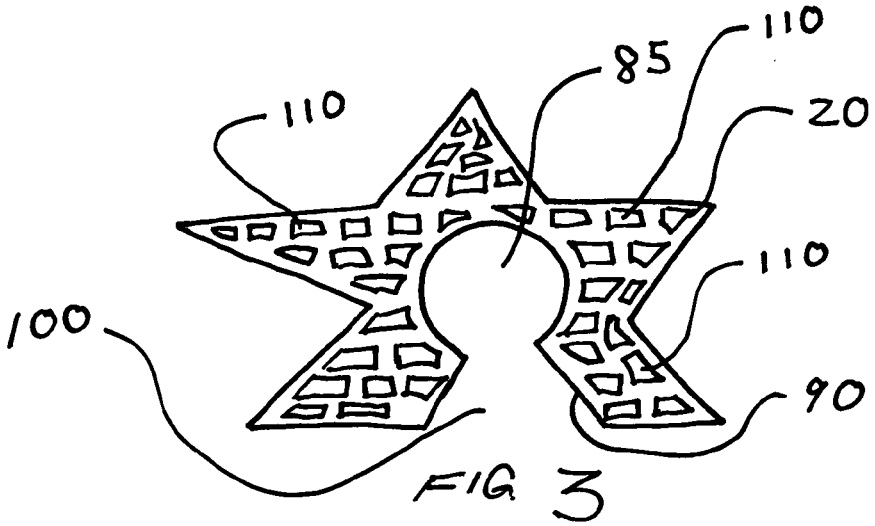
FIG. 3 is a view of an opaque cover in an unassembled configuration.

FIG. 3 illustrates an embodiment of the opaque cover 20 in a pre-assembled state. A light aperture 85 may be disposed in substantially the middle of the opaque cover 20. The opaque cover 20 may have an opaque cover cutout 100 in a pre-assembled state, so that when placed on the conical shaped skin contact member 40 the opaque cover edges 90 are disposed adjacent to each other, as illustrated in FIG. 2. FIG. 3 also illustrates alternate angle members 110 disposed on the outside surface of the opaque cover 20.

Figure 4:
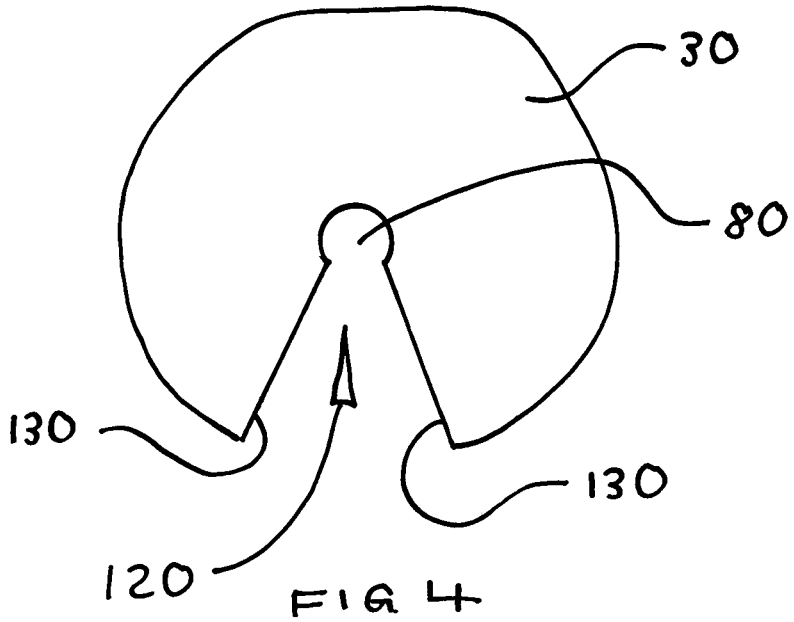
FIG. 4 is a view of a color enhanced member in an unassembled configuration.

FIG. 4 illustrates a light aperture 80 in the color enhancement member 30. The color enhancement member 30 has a color enhancement member cut-out 120. When the color enhancement member 30 is formed in a conical shape over the skin contact member 40, the color enhancement member edges 130 may be positioned adjacent to each opposing color enhancement member edge 130.

The color enhancement member 30 may be clear or translucent. It may be colored, for example it may be pink and clear, blue and clear, or any color. Similar to a tinted lens or window. The color enhancement member 30 may be speckled with different colors.

Figure 5:
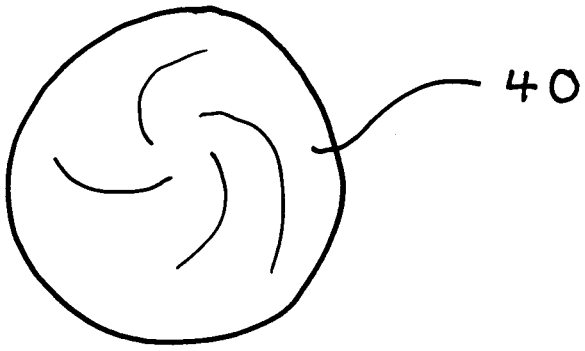
FIG. 5 is a perspective view of a skin contact member.

FIG. 5 illustrates an embodiment of the skin contact member 40 of the present invention 10. As described above, it may have a circular shape, or a circular base, and the center may extend away from the base to form a cone shape, as seen in FIG. 1. However the base of the cone may be of any geographical shape, such as square, triangular, amorphous, or octagonal.

Figure 6:
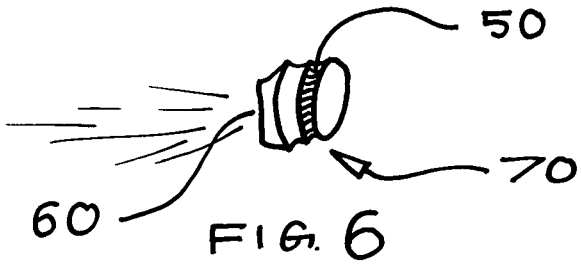
FIG. 6 is a perspective view of an embodiment of a light with switch of the present invention.

FIG. 6 illustrates an embodiment of the skin contact member light 60. A light with switch 70 may be used if the user wants to turn the skin contact member light 60 on and off with a switch, forming a light with switch 70. In one embodiment the light with switch 70 may be about ¾ inch in diameter and may be centered immediately adjacent and in front of the skin contact member 40. The light and switch 70 may be secured in place because it is positioned in the light aperture 80 of the color enhancement member and the light aperture 85 of the opaque cover 20.

In one embodiment the opaque cover 20 may be reflective or silver like a mirror, or have reflective properties. The opaque cover 20 may have a plurality of alternate raised surface members 110 that cause light to deflect and reflect from said opaque cover 20 to display different dark and light features.

The skin contact member light 60 is not directed at the opaque cover 20, but is disposed in the opaque cover light aperture 85 and directs light toward the skin contact member 40.

Figure 7:
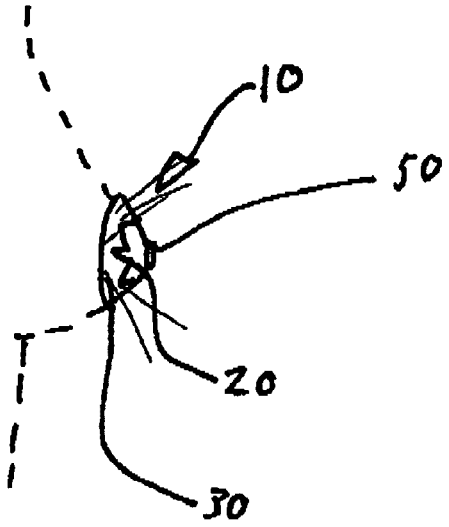
FIG. 7 is a perspective view of an illuminated nipple cover with light rays emanating from the color enhanced member.

FIG. 7 illustrates an embodiment of the present invention 10 disposed on the user. The skin contact member 40, best seen in FIG. 1, is removably disposed on the breast of the user due its adhesive properties. One type of skin contact member 40 is silicone. The color enhancement member 30 is disposed on the skin contact member 40, and the opaque cover 20 is secured to the color enhancement member 30.

The skin contact member light 60 may be steady, or blinking. It me be steady and different colors, or blinking and different colors, or flashing with different colors.

The opaque cover 20 may be secured to the color enhancement member 30 by small amounts of glue.

In one embodiment the skin contact member light 60 may be positioned so that the emitting light is directed towards the skin contact member 40. The light rays then are dispersed throughout the skin contact member 40, which may be silicone, and it may be partially translucent. As the light rays are dispersed the color enhancement member is illuminated, and the opaque member 20 shape can be seen because the background, which is the color enhancement member 30, is illuminated.

In one embodiment the skin contact member light 60 may be battery operated.

In one embodiment, as seen in FIG. 6, the battery may be disposed within the light with switch 70. The switch 50 may be configured to turn on or off by rotating the switch 50 clockwise or counterclockwise.

When the present invention is purchased, there may be a plastic backing that can be peeled off to expose the adhesive surface 140 of the inside of the skin contact member 40 so the skin contact member 40, or usually the entire illuminated nipple cover 10 may be adhered to the body over the nipple of the user.

Figure 8:
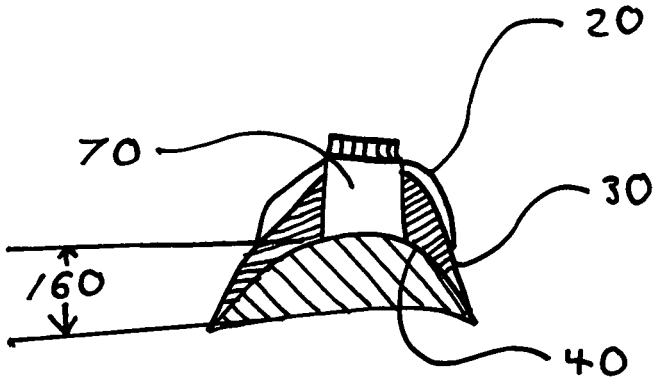
FIG. 8 is a sectional view of an embodiment of the present invention.

FIG. 8 shows one embodiment of a cross sectional view of the present invention 10.

The skin contact member 40 has the dome or conical shape to comfortably fit over the nipple. The color enhancement member 30 may be placed over the skin contact member 40. The opaque cover 20 may be securely disposed over the color enhancement member 30. The light and switch 70 may be secured so as to not fall out by being force fit in the color enhancement light aperture 80 and the opaque cover light aperture 85. In this embodiment the light rays or photons shine or are directed toward the skin contact member 40 or toward the users body if it is being worn. The color enhancement member 30 is then illuminated, and the opaque cover 20 may not be in this embodiment. Thus if the opaque cover 20 is in the form of a star, then someone looking at the user in the dark, sees a black star, with an illuminated circle behind the star.

In one embodiment the height 160 of the skin contact member 40 from base to inside height may be about ½ inch to 1 inch.

In one embodiment the opaque cover 20 may be decorated with rhinestones, jewelry and the like.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The inventions should therefore not be limited by the above described embodiment, method, and examples, but by all embodiments and methods within the scope and spirit of the invention.

It should be understood, of course, that the foregoing relates to exemplary embodiments of the invention and that modifications may be made without departing from the spirit and scope of the invention as set forth in the following claims.

I claim:

1. An illuminated nipple cover for a breast , comprising:

a skin contact member (40) having a conical shape and having an adhesive surface (140) on a concave side:

a skin contact member light (60) positioned forwardly from said skin contact member (40), directing light rearwardly toward said skin contact member (40).

2. The apparatus of claim 1, whereby said skin contact member (40) is translucent and is illuminated by said skin contact member light (60).

3. The apparatus of claim 1, further comprising a color enhanced member (30) disposed on a convex side of the skin contact member (40) said color enhanced member 30 having a color enhancement member light aperture 80; an opaque cover 20 secured to a front side of said color enhanced member 30; said opaque cover 20 having an opaque cover light aperture 85; said skin contact member light 60 secured within said color enhancement member light aperture 80 and said skin contact member light 60 secured within said opaque cover light aperture 85.

4. The apparatus of claim 1, further comprising an opaque cover (20) disposed, on a convex side of said skin contact member (40).

5. The apparatus of claim 2, further comprising a color enhanced member (30) disposed on a convex side of the skin contact member (40).

6. The apparatus of claim 2, further comprising an opaque cover (20) disposed on a convex side of said skin contact member (40).

7. An illuminated nipple cover for a breast, comprising:

a skin contact member (40) having a conical shape and having an adhesive surface (140) on a concave side:

a skin contact member light (60) adjacent to said skin contact member (40);

a color enhancement member (30) secured to a front side of said skin contact member (40); said color enhanced member (30) having a color enhancement member light aperture (80);

an opaque cover (20) secured to the front side of said color enhanced member (30); said opaque cover (20) having an opaque cover light aperture (85); said skin contact member light (60) secured within said color enhancement member light aperture (80) and said skin contact member light (60) secured within said opaque cover light aperture (85).

8. The apparatus of claim 7, whereby said skin contact member light (60) directs light toward said skin contact member (40).

* * * * *